US005746704A

United States Patent [19]

Schenck et al.

[11] Patent Number: 5,746,704

[45] Date of Patent: May 5, 1998

[54] THERAPY APPARATUS HAVING A PASSIVE MOTION DEVICE FOR FLEXING A BODY MEMBER

[76] Inventors: Robert R. Schenck, 1100 N. Lake Shore Dr., Chicago, Ill. 60611; Walter Richard Krevald, 696 W. Lincoln La., Des Plaines, Ill. 60018

[21] Appl. No.: 511,144

[22] Filed: Aug. 4, 1995

[51] Int. Cl.[6] ..... A61H 1/00

[52] U.S. Cl. ..... 601/40; 601/5; 601/33

[58] Field of Search ..... 601/5, 23, 33, 601/34, 35, 40; 482/44–46, 69, 70; 189/748; 104/173.1, 183

[56] References Cited

U.S. PATENT DOCUMENTS

| | | | |
|---|---|---|---|
| 219,439 | 9/1879 | Blend | 482/69 |
| 339,655 | 4/1886 | Huey et al. | 104/173.1 |
| 2,353,129 | 7/1944 | DeMona . | |
| 3,020,908 | 2/1962 | Daniels et al. . | |
| 3,457,912 | 7/1969 | Clark et al. . | |
| 3,582,069 | 6/1971 | Flick et al. | 601/33 |
| 3,714,940 | 2/1973 | Palmer . | |
| 3,756,222 | 9/1973 | Ketchum . | |
| 3,769,970 | 11/1973 | Swanson . | |
| 3,987,735 | 10/1976 | Lofink | 104/183 |
| 4,487,199 | 12/1984 | Saringer . | |
| 4,526,505 | 7/1985 | Mally et al. | 198/748 |
| 4,537,083 | 8/1985 | Saringer . | |
| 4,576,148 | 3/1986 | Koerner et al. . | |
| 4,607,625 | 8/1986 | Schenck . | |
| 4,644,938 | 2/1987 | Yates et al. . | |
| 4,665,900 | 5/1987 | Saringer . | |
| 4,716,889 | 1/1988 | Saringer . | |
| 4,724,827 | 2/1988 | Schenck . | |
| 4,772,012 | 9/1988 | Chesher . | |
| 4,875,469 | 10/1989 | Brook et al. . | |
| 4,945,902 | 8/1990 | Dorer et al. . | |
| 4,962,756 | 10/1990 | Shamir et al. . | |
| 5,211,279 | 5/1993 | Abbestam et al. | 198/748 |
| 5,303,696 | 4/1994 | Boice | 601/40 |
| 5,472,407 | 12/1995 | Schenck . | |

FOREIGN PATENT DOCUMENTS

| | | |
|---|---|---|
| 29 66 18 | 2/1917 | Germany . |
| 176400-A2 | 10/1992 | U.S.S.R. . |

OTHER PUBLICATIONS

Sutter Biomedical, Inc. (Product Literature) "Sutter CPM™ 5000 — Continuous Passive Motion For the Hand", dated Jan. 1984.

Thera Kinetics, Inc., (Product Literature) "Jace H550 Wrist CPM", dated May 1993.

Thera Kinetics, Inc., (Product Literature) "Jace H440 Hand CPM", dated Jul. 1994.

(List continued on next page.)

*Primary Examiner*—Jeanne M. Clark
*Attorney, Agent, or Firm*—Fitch, Even, Tabin & Flannery

[57] ABSTRACT

An apparatus are provided for flexing a body member to rehabilitate the same. For early motion of flexure tendons or the like, very small ranges, for example, 2° to 5° of tension and flexion may be set at opposite ends of a full range of motion for the joint. The drive motor is preferably a stepper motor or the like that is controlled by a microprocessor-based controller to travel through small, variable, early motion ranges for tension and flexion of variable distances and for a variable number of cycles. The illustrated apparatus for pulling a carriage for travel in a forward or reverse direction compresses a slide guide for guiding the carriage for sliding travel thereon about a predetermined path having a curved portion about which the carriage slides when being pulled in a forward direction and in a reverse direction. A flexible tension member is associated with the slide guide and connected to the carriage to exert a pulling force on the carriage to cause it to slide in forward and reverse directions along the slide guide in the predetermined path having a curved portion. The drive is connected to the flexible tension member to exert a pull on the tension member to cause it to travel in either in a forward or reverse direction and to pull the carriage to slide on the slide guide in the same direction as the tension member is pulled

9 Claims, 3 Drawing Sheets

OTHER PUBLICATIONS

Toronto Medical Corp. (Product Literature) "Mobilimb™ Hand CPM Units", dated 1984.

David A. Carus et al., *Research Digest, Dundee Institute of Technology,* 1990–92, Apr. 1993.

D. Carus et al., "The Role of Continuous Passive Motion for the Treatment of Finger Joint Stiffness", 1995.

D.A. Carus et al., "The Technical Development and Clinical Evaluation of a Continuous Passive Motion System for the Rehabilitation of the Injured Hand", 1995.

Ketchum et al., "Electrically driven hand splint", *The Journal of Hand Surgery,* vol. 4, No. 5, Sep. 1979, pp. 476–477.

G. Neff et al., "The Effects of Continuous Passive Motion Upon Stiff Finger Joints", Proceedings, Seventh World Congress of ISPO, Jun. 28–Jul. 3, 1992, Chicago, Illinois., p. 71.

R. Roser et al., "Continuous Passive Motion Device for the Rehabilitation of Impaired Finger Joints", 1995.

*Journal of Hand Surgery,* vol. 111A, No. 6, Nov. 1986, p. 851.

Thera–Kinetics Catalogue, pp. 6 and 7.

THERAPY APPARATUS HAVING A PASSIVE MOTION DEVICE FOR FLEXING A BODY MEMBER

FIELD OF THE INVENTION

This invention relates to an apparatus for flexing body members to rehabilitate the same and to a pull-pull carriage for use in such apparatus as well as in other apparatus.

BACKGROUND OF THE INVENTION

As disclosed in Schenck U.S. Pat. No. 4,724,827, it has long been known that subjecting injured or diseased joints to passive motion, preferably continuing motion, has value in the healing process, particularly with respect to stiffness in the joints and deterioration of cartilage tissue in the joints. Clinically, it has been demonstrated that use of devices which continually flex joints of injured body members can assist in joint rehabilitation. It is believed that the continuous motion generally reduces muscle atrophy and helps to keep joints flexible, which in turn generally accelerates the healing process. It is also thought that such continuous motion accelerates the generation of hyaline, a type of bone cartilage. The use of continuous motion may assist in promoting the growth of implanted cultured cartilage cells.

Various devices have been utilized to provide continuous flexing motion to the joints of a body member, such as a finger. One such prior device is disclosed in applicant's copending application, Ser. No. 08/135,904, U.S. Pat. No. 5,472,407, which is hereby incorporated in its entirety. The device described in that application includes a support brace or cast attached near the wrist which has a hoop-shaped frame extending from the support defining an arcuate path outward of the tip of the finger(s) to be rehabilitated. A carriage having a pair of rollers is reciprocally driven about the hoop-shaped frame. The hoop has a channel therein which receives a relatively stiff cable. The cable is attached at one end to a fixed central rod extending from the axle of the rollers into the channel and at its other end to a drive motor. The motor drives the carriage by continuously shifting the direction of cable movement between forward and reverse directions to alternatively push and pull the carriage about the hoop so as to propel the carriage reciprocally about the frame. Flexing of a finger is achieved by attaching the finger to the carriage as it traverses the hoop-shaped frame with the caster wheels rotating on the surface of the hoop to thereby alternately flex and extend the finger.

Despite the advantages over the prior art provided by the above design, particularly with respect to size and expense, it was found that the rollers necessitated use of a hoop having surface area sufficiently large to properly engage the rollers for rotation thereon. In addition, if the rollers were eliminated and sliding travel employed in a push-pull propelling of the carriage as described in the above-referenced application, the cable used to propel the carriage could cause problems as the carriage traversed the arcuate portion of the frame. More specifically, with the cable being utilized to both push and pull the carriage about the arcuate portion, there would be a tendency for the stiff cable to cause the sliding carriage to dig into the surface of the frame, which would result in rough and irregular travel of the carriage along the frame. Another potential problem with applicants' prior device is the potential build-up of slack in the cable which can similarly cause the carriage to travel somewhat irregularly along the frame.

SUMMMARY OF THE INVENTION

In accordance with the present invention, there is provided a new and improved method and apparatus for flexing body members to rehabilitate the same, particularly at joints such as finger joints, knee joints, etc. This may involve the early or initial motion of flexure tendons or the like through very small ranges of motion, e.g., 2° to 5° of tension and flexion motions at the opposite ends of a full range of motion, e.g., 95° of motion followed later by a full range of motion through 95°, in this instance. A stepper motor or the like is controlled bv a microprocessor based controller to provide a customized number of cycles and ranges of motion for the particular person and/or the particular application such as for repaired tendons, reduction of adhesions, tendon healing, reduction of tendon scarring, tendon healing, bone healing, cartilage regeneration, enhancement of blood flow at the injury site, etc. The number of degrees of motion in a cycle, the location of the upper and lower limits of motion, the number of cycles of motion for either tension or flexion, speed of the motor, and a full range of motion may be programmed by the patient or doctor or preset in the controller to cause the stepper motor to respond accordingly to the programmed protocol. This is in contrast to only full range motions only of prior art devices. Such small ranges of initial motion can be programmed along with later full ranges of motion to provide a very flexible, customized flexing for a particular individual or for a particular kind of injury.

The apparatus used to provide such small range of early motion or full ranges of motion may include a carriage which is connected to the body member and is guide to travel along a predetermined path of movement and is pulled in both directions of movement by a pull-pull mechanism. More specifically, the apparatus includes a slide guide for guiding the carriage for sliding travel thereon about a predetermined path having a curved portion about which the carriage slides when being pulled in a forward direction and in a reverse direction. A flexible tension member is associated with the slide guide and connected to the carriage to exert a pulling force on the carriage to cause it to slide in forward and reverse directions along the slide guide in the predetermined path having a curved portion. The drive is connected to the flexible tension member to exert a pull on the tension member to cause it to travel in either in a forward or reverse direction and to pull the carriage to slide on the slide guide in the same direction as the tension member is pulled.

The above carriage pulling apparatus is particularly useful as a device for flexing a body member to rehabilitate the same in that by utilizing sliding travel, the carriage and slide guide can be smaller, lighter in weight and less expensive versus the applicant's prior device while at the same providing the carriage with smooth travel about a curved portion of the slide guide as it is pulled in both forward and reverse directions. Moreover, with the pull-pull arrangement for propelling the carriage, little or no slack develops in the tension member as could cause irregular movement of the carriage about the slide guide. Finally, while the carriage pulling apparatus is particularly useful in a device for flexing a body member, one skilled in the art will recognize that the carriage pulling apparatus has even more general utility as with items which must travel in a predetermined path including several turns and stops along the path, such as at workstations on a conveyor line.

In one form of the invention, the tension member is a cable and the drive includes a drum structure upon which the cable winds and unwinds as the cable shifts between forward and reverse direction of travel. The drive can include a rotatable drive shaft and the drum structure includes a drum mounted on opposite drive shaft ends. The cable includes ends thereof connected to the drums upon which the cable winds and unwinds as the drive shaft shifts between rotating in forward and reverse directions, with the cable ends, connected to the drums so as to cause the cable and carriage to travel in the corresponding direction.

The drums have an outer cylindrical surface having spiral threads which allow the drive to evenly wind and unwind cable thereon and therefrom without the wound wire diameter exceeding the thread diameter.

In one form, the attached member is attached to the carriage and the slide guide includes a sleeve having an interior groove having an entrance slot thereto. The tension member travels in the interior groove and the attachment member extends from the carriage through the entrance slot to the interior groove with the attachment member being attached to the tension member in the interior groove.

A first stop member may be mounted on the slide guide providing a first predetermined limit to the travel of the tension member in one of the forward and reverse directions. The drive may include a reversible motor which stalls and reverses direction when the carriage contacts the first stop member causing the tension member and carriage to reverse travel in the other forward and reverse directions.

In another form of the invention, the pulling carriage apparatus, as described above, is used in a device for flexing a body member to rehabilitate the same. The device includes a slide guide defining a predetermined path including a curved portion positioned relative to the body member and at least one connector extending from the carriage and connected to the body member to alternately flex the body member.

In one form, the curved portion has a predetermined length that allows full extension of the body member to enable the carriage to travel thereabout for effectuating full extension of the body member.

The drive can include a control for controlling the number of oscillations, the velocity of the oscillations, and the frequency of oscillations of the carriage along the predetermined path.

In one form, the connector exerts a traction force on the body member as the carriage travels along the predetermined path.

In yet another form of invention, a device for flexing a body member is provided including a guide defining a predetermined path and for positioning adjacent the body member. A carriage is mounted on the guide for travel when being propelled in forward and reverse directions. Actuator structure is provided for exerting a propelling force on the carriage to cause it to oscillate in the forward and reverse directions along the guide and the predetermined path. A drive is connected to the actuating structure to exert a drive force thereon to cause it to oscillate. A control is provided for varying the number of oscillations, the length of travel for a given oscillation, the velocity of oscillations, and the frequency of oscillations along the predetermined path.

The guide can be a slide guide with the carriage being mounted on the slide guide for sliding travel thereon and the actuating structure includes a cable associated with the slide guide and connected to the carriage.

In one form, the drive can be connected to the cable to exert a pulling drive force on the cable to cause it to travel in either a forward or reverse direction and to pull the carriage to slide on the slide guide in the same direction as the cable is pulled.

DETAILED DESCRIPTION OF THE PREFERRED EMBODIMENTS

Figure 1:
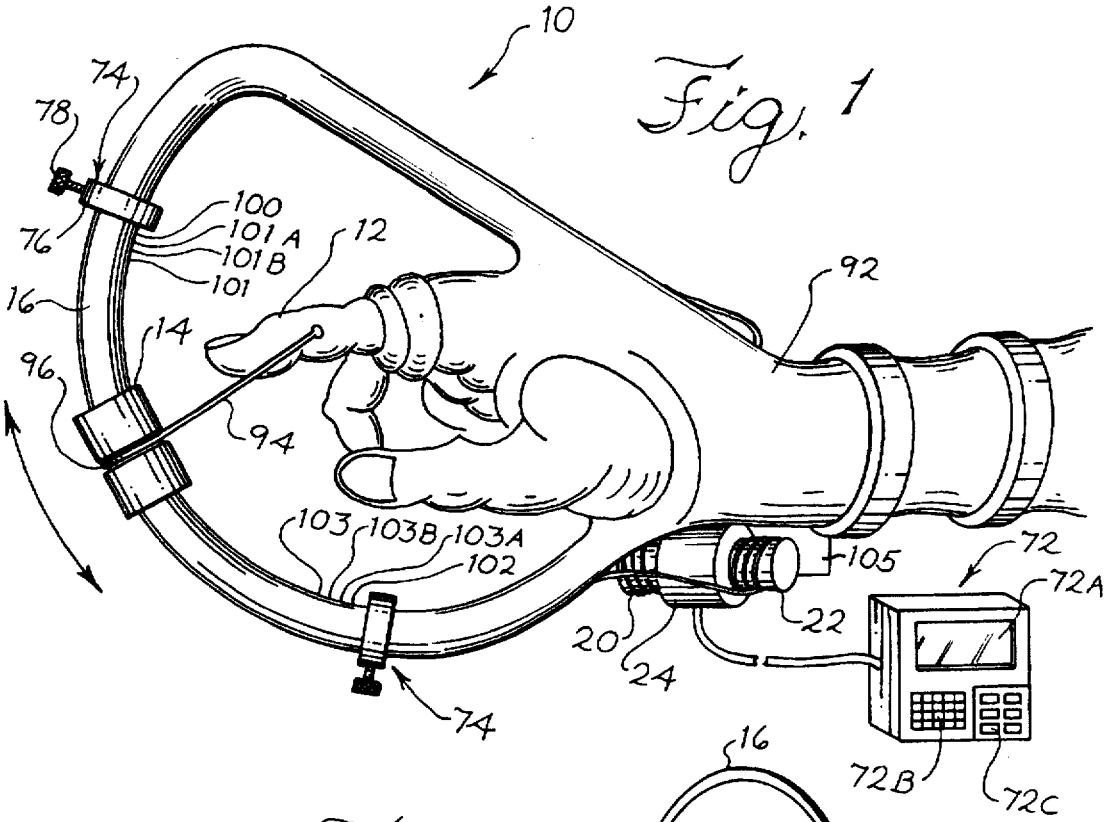
FIG. 1 is a side view of an apparatus embodying various features of the present invention affixed to the forearm and hand of a patient for flexing a finger.

In FIG. 1, a device 10 for rehabilitating a body member 12, such as a fingers is illustrated. In applicant's previously-described device, the provision of rollers requires the hoop to be of a sufficiently large diameter so as to provide adequate surface area for engagement with the rollers. Rollers are also undesirable as they complicate the device by requiring moving parts which the carriage and slide guide device 10 described herein avoid. In addition, if the carriage and slide guide device 10 were to be used with applicants' prior push-pull device as described above, there would be a tendency for the relatively stiff and thick cable connected to the carriage to cause the carriage to dig into the surface of the hoop when propelled in either forward or reverse directions.

Another problem is the slack which can develop in the cable. One source of slack build-up is due to the use of the stiff cable acting to alternately push and pull the carriage along the hoop track. As the cable alternately pushes and pulls the carriage, the cable contacts the sides of the channel in the hoop generating enough friction between the surfaces such that the surfaces of the cable and hoop can tend to progressively wear with continued use of the device. Such surface wear alters the original tolerances built into the device and thus the path within which the cable is directed. This can cause hang-up and a build-up of slack during use of the device. The previously described digging action and the hang-up and potential build-up of slack in the cable as created by the push-pull arrangement with applicant's prior device can cause uneven and irregular travel of the carriage about the hoop producing a jerking type movement of the finger rather than the desired smooth flexing of the finger.

Figure 2:
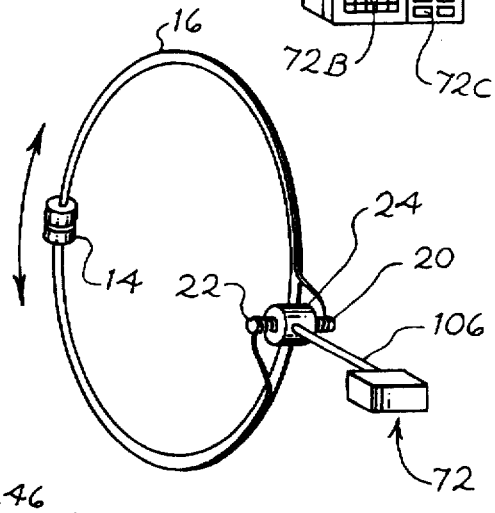
FIG. 2 is a perspective view of a circular guide and carriage mounted thereon according to the present invention including a control for the carriage traveling about the guide.

Referring to FIG. 2, the device 10 has a pull-pull arrangement with a carriage 14 mounted for sliding travel about a slide guide 16. In place of the above-described push-pull cable, a flexible tension member or cable wire 18 is utilized and attached to the carriage 14 and has opposite ends thereof connected to drive drums 20 and 22 such that the wire 18 is under tension with no slack therein. The preferred wire has little or no stiffness that would allow it to be used as a push member to push the carriage, such as was done with the stiff Bowdein wire described in the copending patent application. For example, the wire can be a fishing line such as a braided stainless steel wire, such as a 47 pound test fishing line. A reversible drive motor 24 has a drive axle 25 thereof, which mounts the drive drums 20 and 22. The ends of the wire 18 are connected to the drive drums 20 and 22, respectfully such that with the drive motor 24 in the forward state, one of the drive drums 20 and 22 takes up wire and the other of the drive drums 20 and 22 pays out wire. With the drive motor 24 shifted to a reverse state, the take-up and pay-out function of the drive drums 20 and 22 are reversed; in other words, the one drive drum now pays out wire and the other drive drum now takes up wire. In this manner, the carriage 14 is pulled along the slide guide 16 when travelling in either of the forward or reverse directions; hence, the term pull-pull is used with respect to the device.

This pull-pull arrangement provides an improved mechanical advantage over the push-pull arrangement previously described. More specifically, the pushing required with the previously-described device creates a frictional resistance which is not as easily overcome as the frictional resistance in the pull-pull device 10 disclosed herein. As the stiff, push-pull cable of the previously-described device gradually increases in effective length between the drive and carriage, the cable increasingly tends to want to buckle during pushing in the channel creating undesirable slack therein, as previously discussed, with such tendency being resisted by the thickness and stiffness of the cable employed. Thus, to utilize the pushing arrangement as in applicant's prior device, the cable had to be relatively thick and stiff. However, in an effort to make the device lightweight, relatively thick and stiff cables are not desirable. In the device 10 development of the aforementioned slack is limited with any slack that develops being readily picked up due to the pull-pull arrangement employed such that the carriage 14 can smoothly traverse the slide guide 16 at a constant preselected speed, as will be more fully described herein.

Figure 3:
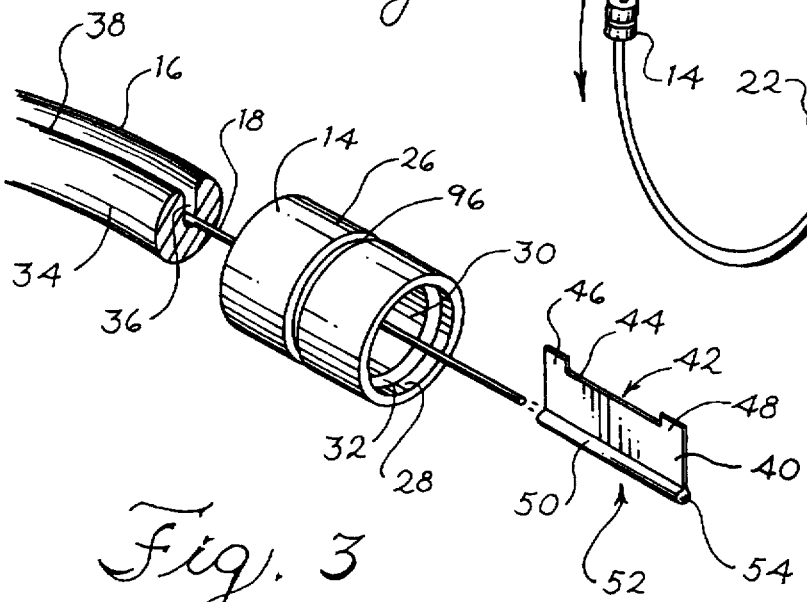
FIG. 3 is an enlarged perspective view of a flexible tension member extending through the slide guide and carriage, and an attachment member.
Figure 4:
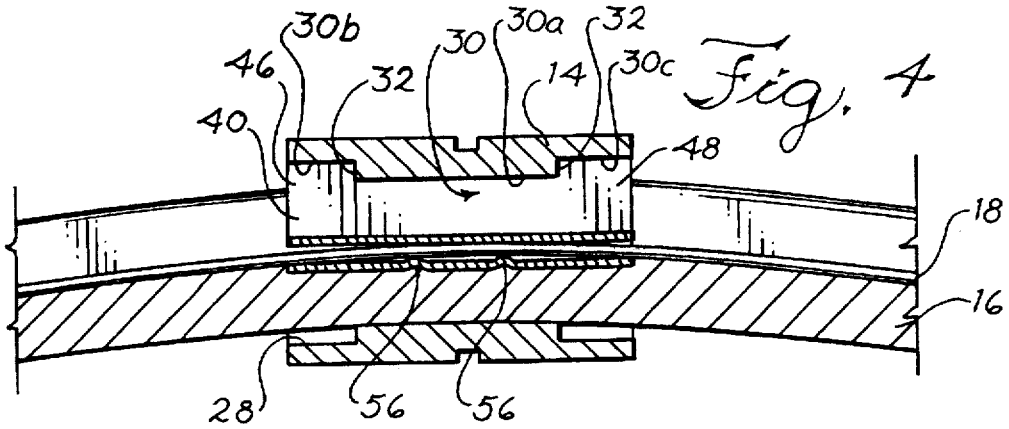
FIG. 4 is an enlarged, side cross-sectional view showing the elements of FIG. 3 in an assembled state.

Turning to FIGS. 3 and 4, the assembly of the carriage 14, the slide guide 16 and the wire 18 will be more specifically described. The carriage 14 has a cylindrical shape with an outer cylindrical surface 26 and an inner cylindrical surface 28. The inner surface 28 has a hollow bore 30 with an inner smaller diameter, cylindrical bore wall **30*a* disposed between a pair of outer larger diameter, cylindrical bore walls 30*b* and 30*c* (FIG. 4). The smaller bore wall 30*a* defines a stepped surface spaced inwardly from the ends of the cylindrical carriage 14. The stepped annular surface 30 forms circumferential shoulders 32 at its juncture with the left and right, larger diameter, bore walls 30*b* and 30*c*. The shoulders 32 are spaced inwardly from the ends of the carriage 14. The slide guide 16 is in the form of a track having an outer surface 34 with a slit channel 36 formed therein. An entrance slot 38 extends along the track 34 and provides the wire 18 access to the interior channel 36**.

To connect the carriage 14 to the wire 18 for movement along the slide guide 16, an attachment member 40 (FIG. 3) is provided. The attachment member 40 is an elongate, generally flat metallic piece having a rectangular profile with a cut out portion 42 along the top side 44 thereof which forms two engagement tabs 46 and 48 at either end of the top side 44 of the attachment member 40. The cut out portion 42 receives the bore wall **30*a* (FIG. 4). The engagement tabs 46 and 48 are sized so that when the attachment member 40 is inserted in the cylindrical carriage 14, the tabs 46 and 48 project into the larger diameter bores 30*b* and 30*c*. The attachment member 40 is sized so that when its bottom side 52 is in the slide channel 36 its top side 44 is abutting the upper surface of the small diameter bore 30*a*. Thus, it will be seen that the attachment member 40 can be press-fit onto the inner surface 28 of the cylindrical carriage 14 with the engagement tabs 46 and 48 tightly gripping the shoulders 32 to attach the member 40 to the cylindrical carriage 14. There is no loose space that would allow the tabs 46 to drop below the shoulders 32** and allow the attachment member to slide outwardly from the bore of the carriage.

To attach the member 40 to the wire 18, an enlarged portion 50 is provided along the bottom side 52 of the attachment member 40. The enlarged portion 50 has a throughbore 54 extending therethrough. The wire 18 can be inserted through the bore 54 with the enlarged bottom portion 50 then being crimped as at 56 to securely attach the member 40 to the wire 18. With the wire 18 and attachment member 40 so attached, the attachment member 40 can then itself be attached to the carriage 14, as by the above-described cooperating tab and shoulder configuration, thereby causing the carriage 14 and attachment member 40 to travel as a unit in a predetermined path on the slide guide 16. The wire 18 thus extends centrally through the cylindrical carriage 14 with the attachment member 40 properly extending from the raised surface 30, as will be more fully described herein. Various other connections could be used between the carriage and the cable.

Figure 5:
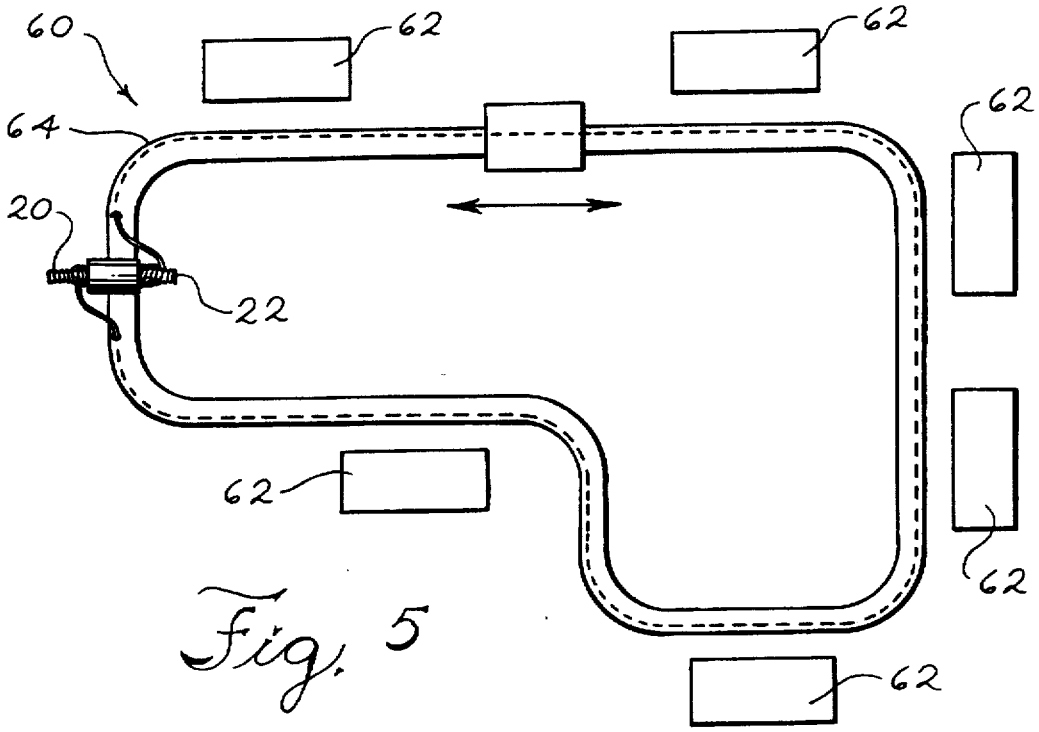
FIG. 5 is a plan view of an alternative embodiment illustrating a drive and schematically showing a slide guide having a carriage thereon for travel to multiple workstations along a conveyor line having multidirectional turns.
Figure 6:
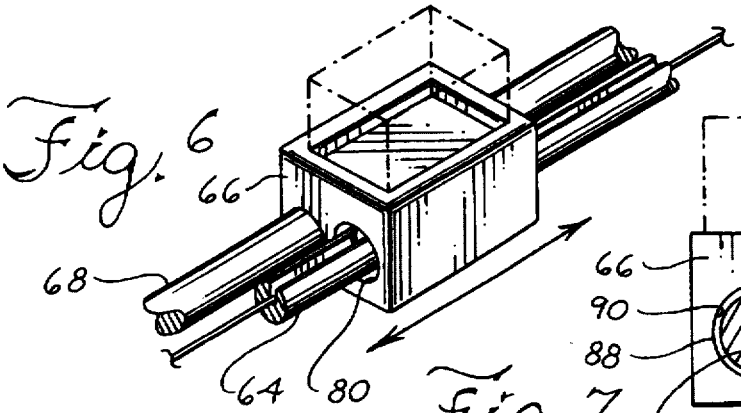
FIG. 6 is an enlarged perspective view of the alternative embodiment of FIG. 5 showing the slide guide with the carriage mounted thereon and illustrating a work piece in phantom on the carriage for travel to multiple workstations.
Figure 7:
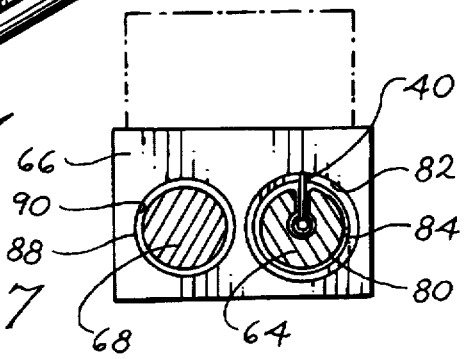
FIG. 7 is an enlarged end view of the carriage and slide guide of FIG. 6., and showing an attachment member.
Figure 8:
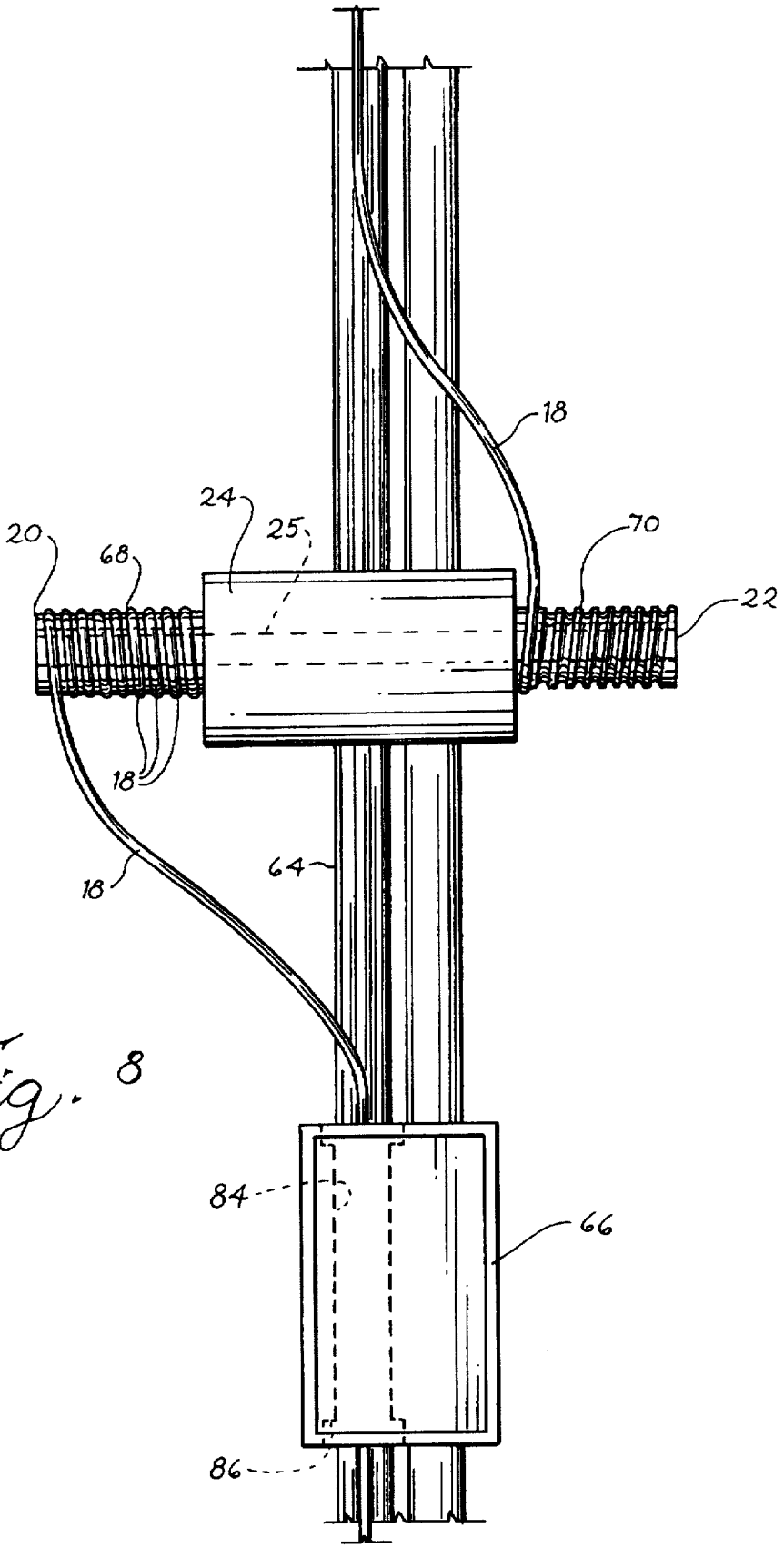
FIG. 8 is an enlarged plan view of the embodiment illustrated in FIGS. 5–7 showing a drive motor having drums on the drive shaft ends for winding and unwinding of a cable connected to the carriage.

As one skilled in the art will appreciate, the device 10 can also be utilized in a conveyor line, shown generally at 60 in FIG. 5, for carrying a work piece to multiple work stations 62 positioned at various locations along the conveyor line 60. It will be apparent that the device 10 will have particular utility in a conveyor line such as 60 which includes a plurality of multi-directional turns. To accommodate a workpiece having some weight to it, the carriage 14 and slide guide 16 assembly of device 10 can be modified slightly, as illustrated in FIGS. 6–8.

The carriage 14 can be enlarged in the form of carriage block 66 so as to provide an increased surface area for support of a workpiece. To provide additional support to the enlarged carriage block 66, the carriage block 66 can be mounted on both a slide guide 64 and a support guide 68 which runs narallel to slide guide 64 along the conveyor line 60 with both the slide guide 64 and support guide 68 extending through the carriage block 66.

With the device 10 used in various systems, such as a clinical rehabilitating device or in the conveyor line 60, the above-described reversible drive motor 24 can be utilized, though it will be described herein with reference to the rehabilitating device illustrated in FIGS. 1–4. The motor 24 can be a conventional reversible motor, preferably a stepper or servo type motor having forward and reverse states. There is a large number of kinds of motors that are either AC or DC and can be controlled to provide precise rotational movements in each of two directions of rotational movement as can stepper motors. As previously set forth, the drive drums 20 and 22 are mounted to the motor drive shaft so as to rotate together in either a forward or reverse direction. To effect the pull on carriage 14, in opposite directions the drums 20 and 22 are provided with oppositely directed spiral threads, 68 and 70, respectively, seen best in FIG. 8. In this manner, wire 18 can be evenly taken up on and paid out from the drums 20 and 22 as the motor 24 is shifted between reverse and forward states to cause the carriage 14 to oscillate in a predetermined path along the slide guide 16. The wire 18 is kept at a constant diameter on the spiral drums 20 and 22, rather than being allowed to build up into a larger diameter coil at drum and a smaller diameter coil at the other end. The diameter of the wire coil, because it is kept at a constant diameter on the spirally grooved drums 20 and 22, travels at the same velocity whether the wire is fully wound or fully unwound on a given drum, e.g., the drum 20. If the wire were allowed to build into a large diameter on one drum, the drum 20, for example, then a revolution would dispense more wire than the other drum 21 having a smaller diameter coil would wind on the drum 21 in the same revolution of the motor shaft for the drums 20 and 21. It is desired to be able to change the velocity of wire travel with changes in the rotational speed of the motor and not with changes in coil diameter on a drum.

To preselect the number of oscillations, the length of travel for a given oscillation, the velocity of oscillations, and the frequency of oscillations of the carriage 16 on the slide guide 16, a control or controller 72 for the motor 24 can be provided in the form of a CPU which can be preprogrammable and/or can include software which receives and responds to user inputted information so as to control the path of the carriage 14 along the guide 16. A keyboard and/or control panel may be provided with the controller to allow the setting of the variable parameters for the particular motions desired for a given patient. When the motor is a stepper motor or the like, the stops may or may not be used; and the controller 72 may cause the motor to move through a predetermined number of steps in a first or positive direction and then stop and reverse to travel through the same number of steps in the negative direction. The motor will than stop and reverse and travel in the positive direction through the predetermined number of steps for a number of cycles which are counted at the controller.

A stop member 74 can be mounted on the slide guide 16 to provide a first predetermined limit to the travel of the carriage 14 in one of the forward and reverse directions. In this manner, the carriage 14 traverses only a portion of the slide guide 16. The position of the guide 16 relative to the finger 12 can determine the degree of tension with which the finger is held, i.e., whether the finger 12 is held in traction by the device 10. The configuration of the guide 16 can be customized so as to provide the desired degree of flexure and tension applied to the body member or finger 12. Preferably, the finger 12 is held under dynamic traction as it is flexed with carriage 14 traversing the guide 16, with the CPU 72 and/or stop member 74 limiting the degree of flexure the finger undergoes.

As illustrated in FIG. 1, the stop member 74 can take the form of a ring 76 and thumbscrew 78 which cooperate to allow the ring 76 to be slid to a preselected position on the slide guide 16, and to then be locked in place thereat by turning the thumbscrew 78 so as to fix the ring 76 on the slide guide 16. When the carriage 14 contacts the stop member 74, the motor 24 stalls and shifts to a reverse direction, so as to correspondingly cause the carriage 14 to travel in a path away from the stop member 74. The CPU 72 can be provided with circuitry such that when the carriage 14 contacts the stop member 74, a counter is initiated by zeroing out and starting a count with the motor 24 again reversing states once a predetermined count has been reached thereby causing the carriage 14 to reverse directions and travel back towards the stop 74. In this manner, the carriage 14 is caused to oscillate at a predetermined frequency in a predetermined path along the slide guide 16. As one skilled in the art will readily appreciate, various other systems can be employed to accurately control the predetermined path of the carriage 14 such as by providing another stop member 74 at the other limit of travel along the pre-determined path, as seen in FIG. 1, or by providing the CPU 72 with circuitry for counting steps of the motor 24 and causing the motor to change states and speeds thereof. Moreover, a closed loop feedback system can be utilized as by providing a shaft encoder and/or sensors along the path and/or on the stop members 74 so as to precisely control the position of the carriage in the predetermined path. With the system wherein a user can input information to the CPU 72 so as to controllably preselect the path, the steps of the motor 24 can be calibrated so as to allow the users to preselect the angular displacement of the carriage in the preselected path and therefore the degree of flexure of the body member 12.

In accordance with the present invention, the apparatus is programmed or controlled to provide an upper range of motion or extension separated from a lower range of motion or flexion. For instance, it may be desired to provide an extension motion of 5° to 10° between marked points 100 and 101 on the slide guide 16 (FIG. 1) for one hundred cycles, and then to shift the carriage along the slide guide to 90° to 95° of flexion motion for ninety cycles between points 102 and 103. Thus, rather than doing a long, continuous cycle between the two stops 74 on the slide guide, giving a full range of motion to the human joint for each cycle, the program controller and motor 24 allow a precise control of the extension and/or flexion over a short limit range of motion adjacent the upper and lower limit stops 74 of the full range of joint motion or between the stops 74 on the slide guide. The extent of the range of motion for tension between points 100 and 101 may be changed or varied within the 100 cycles thereat, in this example. Likewise, the extent of range of motion for flexion between points 102 and 103 may be changed or varied within the ninety cycles thereat, in this example. The range of motion in degrees for tension may be entirely different or the same as the range of motion in degrees for flexion. Additionally, the acceleration and/or deceleration of the carriage 14 by the motor 24 and speed of carriage travel may be changed for a given type of injury rehabilitation.

Within a limited extension or flexion range of motion, the degrees of motion may be varied from one cycle to the next cycle. For example, the first few cycles of tension motion may be only 3° to 4° of motion, e.g., between points 100 and 101A (FIG. 1) followed by the next few cycles of 6° to 7° of motion between points 100 and 101B and then going to the remainder of the extension cycles through the full range of 10° motion between points 100 and 101 .

Likewise, within the flexion range of motion, the number of degrees in a cycle, i.e., the displacement may be varied from one cycle to the next cycle, such as between points 102 and 103A for twenty cycles, then between points 102 and 103B for thirty cycles, and followed by movement between points 102 and 103 for forty cycles. With the apparatus of the present invention, the motor 24, for example, a stepper motor may be moved through a predetermined number of degrees which is equivalent to a predetermined number of steps of the motor necessary to move the carriage 14 from point 102 to 103A; and then the program controller causes a reversal of the motor 24 and the stepping back through the same number of steps to point 102. The program controller counts the number of completed cycles for this range of movement between points 102 and 103A until twenty completed cycles are reached, in this example, and then the program controller 72 causes the stepper motor 24 to step through the number of steps to reach point 103B and then to reverse the direction of rotation and count back through the same number of steps to point 102. The program controller counts to thirty cycles of motion between points 102 and 103B for the carriage, and then shifts to step the motor through the necessary number of steps between points 102 and 103 for forty cycles. After these forty cycles, the controller 72 may be programmed to cause the motor 24 to move the carriage through cycles of the full range of motion between the upper and lower stops 74, as shown in FIG. 1 for a given number of full motion range cycles.

One use of the present invention is to try to generate hyaline cartilage in a joint, such as a knee or finger joint, by putting cartilage culture cells in a polygolic mesh at the joint and then moving the whole joint through small cyclic ranges of movement, e.g., between points 100 and 101A, 100 and 101B, and 100 and 101 for tension, and between points 102 and 103A, 102 and 103B, and 102 and 103 for flexion. The apparatus may be programmed by the individual or his physician to provide a specific cyclic protocol for different individuals, and/or kinds of uses such as for repaired tendon injuries, reduction of adhesions, tendon healing, reduction of tendon scarring, and cartilage generation.

The preferred motor 24 will have an attached battery 105, preferably a rechargeable battery, that is mounted on the cast 92 adjacent the motor 24 to supply current thereto. The preferred motor and battery should be about 2 or 3 lbs. and small enough to be easily carried about during the day, and to be left on while the patient sleeps at night. While the controller 72 may be a large computer connected by wires 106 (as shown in FIGS. 1 and 2), it is also possible to provide very small programmable chips having software thereon mounted on the wrist cast 92 for controlling the motor 24 through various ranges of motion. The controller 72 shown in FIG. 1 has a VCR monitor 72A, and input keyboard 72B, a function control and input keypad 72C and may be a full PC computer, if desired. Rather than the large computer controller (shown in FIG. 1), a much smaller microprocessor-based controller 72 (FIG. 2) may be mounted on the patient's belt with conductors 106 extending therefrom at the belt to the motor 24. The microprocessor-based controller may be provided with a keyboard 72B or other input 72C to input the location of the upper limit of extension, e.g., 0°, and the lower limit of flexion, e.g., 95°, to give the entire full range of motion between 0° and 95°; and to give the upper flexion range of motion, e.g., from 0° at point 100 to 3° at point 101, the lower flexion range of motion, e.g., 90° at point 103 to 95° at point 102. The number of cycles may be also inputted as either a cycle number or as the amount of time to run through a given range of motion. The motor speed may also be varied from slow speeds of less than a cycle per minute to very fast speeds of a number of cycles per minute. Also, the controller may be set to cause the motor 24 to operate with various accelerations and decelerations as well as variable base speeds. The maximum base speed may also be set in the controller.

Returning to the assembly of the carriage 14 to the slide guide 16 with reference to FIGS. 3 and 4, as previously mentioned the carriage 14 is mounted on the slide guide 16. The inner raised annular surface 30 of the carriage 14 has a diameter only slightly greater than the diameter of the slide guide 16 so that with the guide 16 extending through the carriage 14, the channel 36 extends centrally through the carriage 14 and the attachment member 40 is firmly and securely attached to the inner surface 28 of the carriage 14 with the wire 18 correspondingly extending substantially centrally through the cylindrical carriage 14. To minimize the frictional resistance between the raised surface **30*a* and the outer surface 34 of the slide guide 16, the slide guide 16 is preferably made from a plastic material having a low coefficient of friction. The carriage 14 is also molded from a plastic material, such as polypropylene or polyethylene, which has a low coefficient of friction thereby minimizing frictional resistance to sliding travel of the raised surface 30*a* on the track outer surface 34. By providing for sliding travel of the carriage 14 on the slide guide 16, the diameter of the slide guide 16 can be decreased with a corresponding reduction in weight and costs versus applicants' prior device utilizing caster rollers which traverse a hoop frame. Thus, the device 10** enclosed herein is particularly adapted for use in rehabilitating injured body members due to the comfort it affords based on its lightweight construction.

As previously discussed, the device 10 can also be adapted for use with an enlarged carriage block 66 in the conveyor line 60. The device 10 avoids the use of heavy chains and roller carts typically used in conveyor line operations. Thus, when the device 10 is used in conveyor line 60, the expense and maintenance associated with convevor line operations can be significantly reduced as chains typically get very dirty during conveyor line operations and can be fairly expensive.

The slide guide 64 and carriage block 66 are configured similar to the carriage 14 and slide guide 16, in that the carriage block 66 has a first throughbore 80 defined by an inner cylindrical surface 82. The inner surface 82 includes a raised annular surface 84 so that the first throughbore 80 has a stepped diameter with the diameter of the inner surface 82 near the end of the first throughbore 80 being greater than the diameter of the inner surface 82 along the raised surface 84 thereof. Thus, circumferential shoulders 86 are formed at the ends of the raised annular surface 84 so that the attachment member 40 can be press fit thereon, as previously described. The carriage block 66 further includes a second throughbore 88 defined by an inner cylindrical surface 90 of the carriage block 66. Both the diameters of the raised surface 84 and the inner surface 90 are slightly greater than the diameters of the slide guide 64 and support guide 68, respectively, such that the carriage block 66 is firmly and securely supported on the slide guide 64 and support guide 66 while allowing for smooth sliding travel thereon. Preferably, the slide guide 64, support guide 68 and the carriage block 66 are all formed from plastic materials having low coefficient friction values to facilitate the sliding action of the carriage block 66 on the slide guide 64 and support guide 68.

When using the device 10 to flex a finger 12, the device 10 can be supported to the patient's wrist by a variety of well-known means such as described in applicant's prior referenced application. As shown in FIG. 1, the slide guide 16 can be integral with a cast or wrist brace 92. Accordingly, the wrist brace 92 will be formed from the same lightweight, plastic material as the slide guide 16. In this manner, a relatively lightweight, unobtrusive device is provided for rehabilitating a finger 12 which has a fractured bone therein. Finally, to affix the finger 12 to the carriage 14, a connector 94, such as a rubber band or the like can be attached to the finger 12 and wrapped around the carriage 14, such as in an annular groove 96 formed in the outer surface 26 of the cylindrical carriage 14 intermediate the ends thereof.

The foregoing disclosure and specific embodiments described are intended to be illustrative of the broad concepts comprehended by the invention and that various changes and modifications may be made without departing from the spirit of the invention and scope of the claims herein. For instance, the invention is not limited to the described rehabilitating and conveyor embodiments, as it can be used in a wide-variety of applications where reciprocal movement is utilized, such as in plotters where the carriage can be adapted to mount a writing instrument, ink-jet nozzle or the like.

What is claimed is:

1. A device for flexing a body member to rehabilitate the same, the device comprising:

a slide guide having an exterior surface defining a predetermined path including a curved portion positioned relative to the body member;

a carriage having an interior surface mounted on the slide guide exterior surface for sliding travel about the curved portion when being pulled in a forward direction and being pulled in a reverse direction;

at least one connector extending from the carriage and connected to the body member to alternately flex the body member;

a flexible tension member associated with the slide guide and connected to the carriage to exert a forwardly or rearwardly directed pulling force on the carriage to cause it to slide in the forward and reverse directions along the slide guide in the predetermined path having a curved portion for flexing the body member;

a drive connected to the flexible tension member to exert a pull on the tension member to cause it to travel in either a forward or a reverse direction and to pull the carriage to slide on the slide guide in the same direction as the tension member is pulled and to flex the body member; and the slide guide exterior surface and the carriage interior surface being of a low friction material so that with the carriage interior surface engaged on the slide guide exterior surface and the carriage being pulled by the tension member and drive, the carriage interior surface will slide over the slide guide exterior surface with low frictional resistance to sliding of the pulled carriage on the slide guide.

2. An apparatus in accordance with claim 1 including an attachment member attached to the carriage and wherein the slide guide comprises a track having an interior groove including an entrance slot thereto with the tension member traveling in the interior groove and the attachment member extends from the carriage through the entrance slot and to the interior groove with the attachment member attached to the tension member in the interior groove.

3. An apparatus in accordance with claim 1 including a first stop member mounted on the slide guide providing a first predetermined limit to the travel of the tension member and carriage in one of the forward and reverse directions.

4. An apparatus in accordance with claim 3 wherein the drive includes a reversible motor which has forward and reverse states and a stalled state when changing between one of the forward and reverse states to the other so that when the carriage contacts the first stop member the motor is caused to enter its stalled state and change it from the one of the forward and reverse state to the other causing the tension member and carriage to pause and then reverse travel in the other of the forward and reverse directions.

5. A device in accordance with claim 1 wherein the tension member is a cable and the drive includes a drum means upon which the cable winds and unwinds as the cable shifts between forward and reverse directions of travel.

6. An apparatus in accordance with claim 5 wherein the drive includes a rotatable drive shaft and the drum means includes a drum mounted on opposite drive shaft ends with the cable having ends thereof connected to the drums upon which the cable winds and unwinds as the drive shaft shifts between rotating in forward and reverse directions causing the cable and carriage to travel in the corresponding direction.

7. An apparatus in accordance with claim 6 wherein the drums have an outer cylindrical surface having spiral threads allowing the drive to evenly wind and unwind cable thereon and therefrom, respectively, without the wound cable diameter exceeding the thread diameter.

8. A device in accordance with claim 1 wherein the drive includes a control for controlling the number of oscillations, the velocity of the oscillations and the frequency of oscillations of the carriage along the predetermined path.

9. A device in accordance with claim 1 wherein the connector is a resilient band which exerts a traction force on the body member as the carriage travels along the predetermined path.

* * * * *